US006314712B1

(12) United States Patent
Thierron

(10) Patent No.: US 6,314,712 B1
(45) Date of Patent: Nov. 13, 2001

(54) APPARATUS AND PROCESS FOR THE CONTROL OF PIECING IN SPINNING DEVICES

(75) Inventor: Wolfgang Thierron, Erkelanz-Gerderath (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/537,145

(22) Filed: Mar. 29, 2000

(51) Int. Cl.[7] ..... D01H 13/00
(52) U.S. Cl. ..... 57/263
(58) Field of Search ..... 57/261, 263, 264

(56) References Cited

U.S. PATENT DOCUMENTS

| | | | | |
|---|---|---|---|---|
| 4,150,530 | | 4/1979 | Derichs . | |
| 4,524,578 | | 6/1985 | Raasch et al. . | |
| 5,456,073 | * | 10/1995 | Thierron et al. | 57/263 |
| 5,509,262 | | 4/1996 | Stahlecker . | |
| 5,535,580 | * | 7/1996 | Sebastian et al. | 57/263 |
| 5,640,838 | * | 6/1997 | Billner et al. | 57/263 |
| 5,694,756 | * | 12/1997 | Lindner | 57/263 |
| 5,765,770 | * | 6/1998 | Hermanns et al. | 242/476 |
| 5,799,478 | | 9/1998 | Legrom . | |
| 5,916,119 | * | 6/1999 | Lovas et al. | 57/263 |
| 6,035,622 | * | 3/2000 | Fox et al. | 57/263 |

FOREIGN PATENT DOCUMENTS

| | | | | |
|---|---|---|---|---|
| 4121387A1 | | 1/1993 | (DE) . | |
| 4215005A1 | | 11/1993 | (DE) . | |
| 2507199 | * | 9/1976 | (DE) | 57/263 |
| 4121387 | * | 1/1993 | (DE) | 57/263 |
| 4313753 | * | 11/1994 | (DE) | 57/263 |
| 19620377 | * | 11/1997 | (DE) | 57/263 |
| 2137782 | | 12/1972 | (FR) . | |
| 2284480 | | 6/1995 | (GB) . | |

OTHER PUBLICATIONS

German Patent Office Search Report, Aug, 17, 1999.

* cited by examiner

*Primary Examiner*—Danny Worrell
(74) *Attorney, Agent, or Firm*—Dority & Manning

(57) ABSTRACT

The present invention relates to a process for the control of the piecing process in a spinning device, in particular an open-end spinning device with rotors, as well as to a device to carry out the process. It is the object of the present invention to make it possible to trigger the piecing process without having to change the structure of the rotor or of the bearing disks of a spinning device. This problem is solved in that the piecing process is carried out and/or controlled in function of physical magnitudes or states and/or their changes in a spinning device. According to the invention, the device is provided with a measuring device to detect physical magnitudes connected with the control of the piecing process.

19 Claims, 1 Drawing Sheet

APPARATUS AND PROCESS FOR THE CONTROL OF PIECING IN SPINNING DEVICES

BACKGROUND OF THE INVENTION

The present invention relates to a process and a device for the control of the piecing process in a spinning device, such as an open-end spinning rotor.

It is known from German patent 25 07 199 A1 that the piecing process is controlled through contact-less measurement of the rotational speeds of open-end spinning rotors. The rotors are made with colored markings serving as reflectors. A photoelectric impulse receiver placed at a short distance and emitting a light ray receives the light ray reflected from the marking. In this manner, the momentary rotational speed of the rotor is scanned without contact, and the beginning of the piecing process is initiated as a function of the monitored piecing behavior of the spinning rotor. Impulses proportional to the rotor speed were used for the control of the piecing process, in particular to control fiber feed and yarn draw-off.

Further developments of this technical idea is that the rotor speed in open-end spinning devices is not measured directly, but rather that the speed of the bearing disks of the open-end spinning rotors is measured. In this case, the bearing disks were provided with reflectors for contact-less measurement of the rotational speed. Bearing disks of this type are known, e.g., from German patent 41 21 387 A1. Two reflectors are imbedded in suitable recesses in the surface of one face of the bearing disks. However, the optical measuring of rotational speed no longer provides reliable and clear signals in case of heavy fly from the fiber material to be spun.

This problem was solved by building small magnetic pins into the bearing disks (German patent 43 13 753 A1). In this design of a bearing disk, above all, care must be taken to insure above all that the bearing disks with the built-in magnetic pins should present as flat and smooth a surface as possible, so that neither high points nor low points are formed.

This care applies also to the attachment of reflectors on other bearing disks (German patent 196 20 377 A1). This is generally so because even a small imbalance results in enormous centrifugal forces at the usual rotational speeds, so that the bearing disk may be damaged or even destroyed. Extensive damage of the spinning devices is also unavoidable in that case.

The method of contact-less measurement of the rotor speed is based solely on the principle that a signal emitter transmits an impulse signal to an impulse receiver. As a rule, a frequency measurement or speed measurement of moving parts in the rotor (bearing disks), or of the rotating rotor, are made. If the method for measuring the speed is to be one with reflectors on the bearing disks, the signal emitter is made in the form of a light source. The emitted light is reflected in a pulsating manner as the reflector passes, so that an impulse receiver records the light impulse. If the bearing disks are provided with magnetic pins, it also means that the magnetic pins are designed as signal emitters producing magnetic field lines which produce an induction current in an impulse receiver. In either case, the impulse receiver, in principle, solely records impulses that are proportional to the rotor speed.

For this type of rotational speed measuring, the bearing disks necessarily require especially high fabrication quality. Furthermore, magnetic forces of the magnetic pins may magnetize other materials in the spin box susceptible to magnetization and cause additional interference. Under certain circumstances, the impulse emitter must be positioned precisely for the impulses to be counted by the impulse receiver. In addition, interference may be produced due to the fact that the spinning device is being soiled by fly during the spinning process.

OBJECT AND SUMMARY OF THE INVENTION

It is, therefore, a principal object of the present invention to make it possible to control piecing without changing the structure of the rotor or of the bearing disks at all, e.g. with reflectors or similar devices, and thus to overcome the disadvantages of the state of the art. Additional objects and advantages of the invention will be set forth in part in the following description or may be obvious from the description, or may be learned through practice of the invention.

The problems with the prior art devices are a process for controlling the piecing process in a spinning device, in particular an open-end spinning device with rotors. By the piecing process and/or the rotor speed are detected and/or controlled as a function of physical magnitudes and/or their changes in the spinning device. A device is used to perform the process for controlling the piecing process in a spinning device. The device is a measuring device to determine physical magnitudes or states in the spinning device, which are linked to the control of the piecing process.

The method for the control of the piecing process is inventive in that the spinning process and/or the rotational speed of the rotor are detected and/or controlled as a function of physical magnitudes or states and/or of their change in a spinning device. "Physical magnitude" or "physical state" are generally to be understood as conditions produced by the piecing process in and on the spinning device that can be detected and described. Due to the spinning process being a continuous operation, these conditions as well as the rotor speed change or can be influenced over time. By contrast with the state of the art, no impulse is detected by an impulse receiver, but the physical conditions or the changes in conditions produced by the rotating rotor itself are detected. The piecing process is controlled on the basis of the directly measured states or conditions.

Advantageously, no structural changes are required on the rotor or on the bearing disks. No special design requirements for the rotor or the bearing disks are needed. Nor for the placement and alignment of the components or of the impulse emitters and receivers, since it is possible to eliminate impulse emitter and receivers. This leads to considerable simplification in construction.

According to a further development of the invention, the internal pressure, the sound pressure, the sound frequency and/or the sound level in the spinning device are detected. These physical magnitudes or states are caused or influenced by the rotor speed and/or the piecing process itself. This measuring principle is based on the fact that the dynamics of the rotor are not detected by means of a special impulse emitter and receiver, but rather through the physical magnitudes and states caused by the rotor speed, or their change. Therefore, an immediate correlation exists between the rotor speed and the physical magnitudes and states produced by the rotor rotation.

In a further development of the invention, at least one reference measurement is noted before the piecing process. In this reference measurement, the rotor is accelerated from a stopped position to operating speed so that reference may be obtained on the behavior of the physical magnitudes and states as a function of the rotor speed. Thus, it may very well happen that variations in the behavior of these physical magnitudes and states take place from one spinning device to another, depending on the rotor selected and other parameters. As a result of the reference measuring being carried out, a yarn production specific to a spinning station can be purposefully controlled during piecing.

It is further proposed, that a device for the control of the piecing process be designed with a measuring device provided for the purpose of detecting physical magnitudes or states in the spinning device, whereby the device is connected to the controls of the piecing process. This measuring device distinguishes itself through the fact that it measures physical conditions produced by the rotation of the rotor in the spinning device or changes in those conditions and transmits them to the controls. The physical conditions and states produced by the direct rotation of the rotors or the bearing disks are measured directly by the measuring device.

The measuring device is advantageously in the form of a measuring sensor to measure, in particular, the internal pressure, the sound pressure, the sound frequency and/or the sound level in a spinning device. The physical states or conditions are characteristics of the environment within the spinning device produced directly by the rotating rotor and depend directly on the speed of the rotor.

In general, the internal atmospheric pressure in the spinning device changes as the rotor speed increases. For this reason, the pressure, or the change in the pressure, can be measured directly in the spinning device. Due to the direct correlation between pressure and rotational speed, the rotational speed is ascertained as the internal pressure in a spinning device is detected, so that the controls of the piecing process take appropriate control and regulating steps. Similarly, this can also apply to sound levels and/or sound pressure.

It is also an advantageous if the spinning device is designed to receive the measuring device or the measuring sensor. The bearing disks according to the state of the art must be produced through high-quality fabrication methods. If fabrication is not precise, this can result in considerable destruction of the disks. Because of these stringent requirements, the manufacturing of these disks is very cost intensive. By comparison the embodiment according to the present invention can be produced simply, since only a small recess for the reception of the measuring device must be provided in the spinning device. The measuring device is placed so that it supplies good and reliable values of the physical conditions it detects.

In addition, it is advantageous if the device is or can be connected to a traveling automatic carriage, which can move relative to the spinning device. In general, many spinning devices, or spinning stations, are provided next to each other in a spinning machine. The traveling automatic carriage moves along these spinning stations as required and called for by the spinning stations in order to service the spinning station in question. This traveling automatic carriage is also needed for the piecing process. For the piecing process itself, the device according to the present invention is connected to the traveling automatic carriage so as to make an optimal piecing process possible. In this case, the device itself can be installed on the traveling automatic carriage. Alternatively, the device or part of the device according to the present invention, e.g., the measuring device, may be located on or in the spinning device. If a piecing process is to be carried out by means of the traveling automatic carriage, the device or the measuring device and/or the controls of the piecing process can be connected to the traveling automatic carriage.

It is also an advantage if the device is connected to the controls of a fiber feed of the spinning device. Thereby, the controls of the fiber feed can be operated purposefully in direct function of the ascertained physical conditions, and the piecing process at a spinning station can take place in direct function of the rotor speed.

Overall, the contact-less speed measuring of the rotor or the bearing disks according to the present invention affords a simple design or realization of construction. It is a further advantage that present spinning devices can be retrofitted by means of this invention. In this case, the present bearings and rotors can still be used. They need not be replaced by expensive and sensitive components or bearing disks. Furthermore, the expensive and effort-intensive rebuilding of a spinning machine is eliminated. Implementation of the present invention therefore makes easy and economic retrofitting possible, so that the value of an already existing spinning machine can be raised considerably since this invention makes it possible to control the piecing process in a purposeful manner.

The invention is explained in further detail through the example of an embodiment.

DETAILED DESCRIPTION

Figure 1:
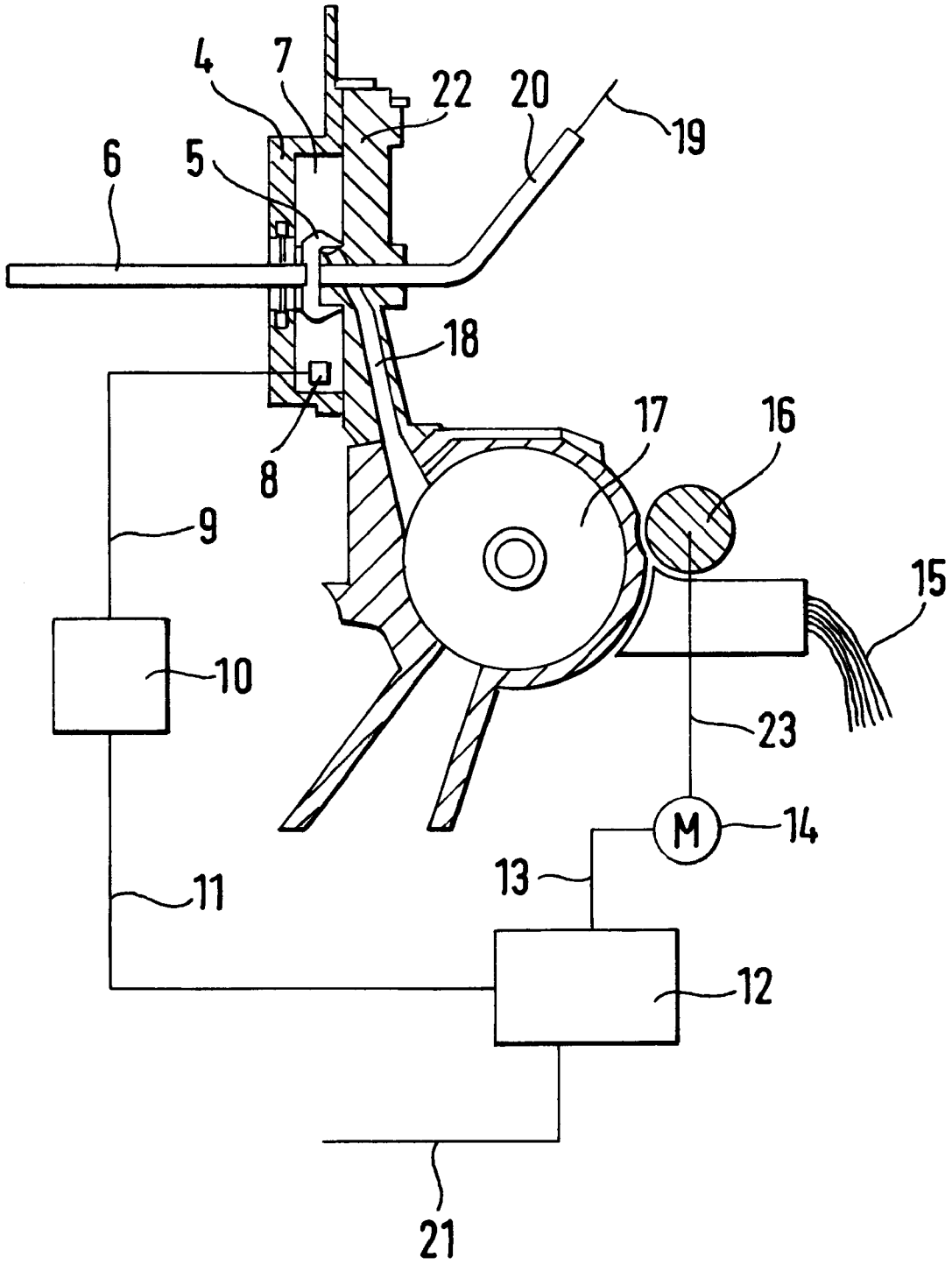
FIG. 1 shows a schematic section through a spinning device.

Reference will now be made in detail to the preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

According to the figure, the spinning device is provided with a housing 4 containing a spinning element 5. The spinning element 5 has a shaft 6 which is driven by means of a known bearing which is not shown.

Housing 4 is closed off by a housing lid 22, so that an internal chamber 7 is formed. In addition, a sensor 8 to measure the pressure conditions prevailing in the internal chamber is located in the internal chamber 7. The sensor 8 is connected to a measuring device 10 by means of a connection 9. The measuring device 10 displays the measuring signals of the sensor 8 or evaluates and transmits them via a connection 11 to a control unit 12 for controlling the piecing process.

The control unit 12 conveys the control commands via a connection 13 to a motor 14 which is connected via connection 23 to a delivery roller 16. In addition, the control unit 12 is connected via a connection 21 to additional devices of a spinning machine, for example, to traveling service units central to the machine.

During piecing or run-up of the spinning element 5, the sensor measures the pressure conditions in the internal chamber 7 of housing 4. The pressure in the internal housing changes with the speed of the spinning element 5. The measured state or the changes of the internal pressure are transmitted directly to the control unit 12, so that it controls the motor 14 of the delivery roller 16 as a direct function of the air pressure in the internal chamber 7. In this manner, as a function of the existing physical conditions in the internal chamber 7 of housing 4, the drawing-in of the fiber sliver 15 by the delivery roller 16 is effected and influenced. The speed of the spinning element 5, and thereby the pressure conditions in the internal chamber, change continuously during run-up of the spinning element 5. Due to this fact, the change in speed or pressure, as well as the delivery of the fiber sliver 15 via a known combing roller 17 and a fiber feeding channel 18 to the spinning element 5, is varied correspondingly.

A yarn 19 spun by the spinning element 5 from the fiber sliver 15 delivered to it is removed by a yarn draw-off opening 20 and is conveyed to a bobbin (or cone) which is not shown here.

By means of the invention, it is possible to determine without contact the pressure conditions in the internal chamber 7, which change directly with a change in the speed of the spinning element 5.

In further developments of the invention, the sensor 8 can be designed in the internal chamber 7 to measure other or additional physical conditions which change as a function of the rotational speed of the spinning element 5. As a result, the rotational speed is measured directly, without contact, and without any structural changes in the spinning element itself being necessary.

Before carrying out a piecing process, it is recommended to take a reference measurement of the physical conditions without fiber feeding. This reference measurement can then be used for a spinning-station-specific yarn production during piecing.

It should be apparent to those skilled in the art that modifications and variations can be made to the embodiment of the invention described herein without departing from the scope and spirit of the invention as set forth in the claims.

What is claimed is:

1. A method for controlling the process of piecing yarn in a spinning device, said method comprising the steps of:

detecting with a sensor at least one measurable physical state within the spinning device that varies as a function of rotational speed of a spinning element within the spinning device without directly sensing or detecting rotational movement of the spinning element;

measuring with a measuring device the physical state within the spinning device that is detected by the sensor;

determining with the measuring device the rotational speed at which the spinning element within the spinning device spins; and controlling the piecing process dependent upon the measurements of the physical state and the determined speed of the spinning element.

2. A method as in claim 1, wherein the spinning device is a spinbox within an open-end spinning frame and the spinning element is an open-end spinning rotor.

3. A method as in claim 1, wherein the physical state detected by the sensor is at least one of internal pressure, sound pressure, sound frequency and sound level within the spinning device.

4. A method as in claim 1, wherein the physical state that is detected and measured within the spinning device is internal pressure.

5. A method as in claim 1, wherein the physical state that is detected and measured within the spinning device is sound pressure.

6. A method as in claim 1, wherein the physical state that is detected and measured within the spinning device is sound frequency.

7. A method as in claim 1, wherein the physical state that is detected and measured within the spinning device is sound level.

8. A method as in claim 1, wherein at least one reference measurement of the physical state is recorded before the piecing process.

9. A device for controlling the process of piecing yarn in a spinning device having a spinning element therein, said device comprising:

a sensor for detecting at least one measurable physical state within said spinning device that varies as a function of rotational speed of said spinning element without directly sensing or detecting rotational movement of said spinning element;

a measuring device in connection with said sensor for measuring said physical state within said spinning device that said sensor detects;

wherein said measuring device determines the speed of said spinning element within said spinning device; and a control device that is connected to said measuring device which controls the piecing of the yarn dependent upon said measurements of said physical state and the determination of said speed at which said spinning element rotates.

10. A device as in claim 9, wherein said spinning device is a spinbox within an open-end spinning frame and said spinning element is an open-end spinning rotor.

11. A device as in claim 9, wherein said spinning device comprises a housing within which said spinning element rotates, said sensor disposed within said housing.

12. A device as in claim 11, wherein said measuring device is disposed within the housing of said spinning device.

13. A device as in claim 11, wherein said measuring device is remotely located from said housing.

14. A device as in claim 9, wherein said sensor and said measuring device detect and measure at least one of internal pressure, sound pressure, sound frequency, and sound level within said spinning device.

15. A device as in claim 9, wherein said sensor and said measuring device detect and measure the internal pressure of said spinning device.

16. A device as in claim 9, wherein said sensor and said measuring device detect and measure the sound pressure within said spinning device.

17. A device as in claim 9, wherein said sensor and said measuring device detect and measure the sound frequency within said spinning device.

18. A device as in claim 9, wherein said sensor and said measuring device detect and measure the sound level within said spinning device.

19. A device as in claim 9, wherein said device is in operative communication with the controls of a fiber feed of said spinning device.

* * * * *